United States Patent [19]

Terry

[11] 4,018,481

[45] Apr. 19, 1977

[54] GASIFICATION OF COAL IN SITU

[75] Inventor: Ruel Carlton Terry, Denver, Colo.

[73] Assignee: In Situ Technology, Inc., Denver, Colo.

[22] Filed: Mar. 8, 1976

[21] Appl. No.: 665,128

[52] U.S. Cl. ..... 299/4; 166/261; 166/267

[51] Int. Cl.[2] ..... E21C 43/00

[58] Field of Search ..... 48/DIG. 6; 166/256–261, 166/267; 299/2, 4, 5

[56] References Cited

UNITED STATES PATENTS

| | | | |
|---|---|---|---|
| 947,608 | 1/1910 | Betts | 299/2 |
| 3,628,929 | 12/1971 | Glass et al. | 299/2 |
| 3,734,184 | 5/1973 | Scott | 166/261 |
| 3,794,116 | 2/1974 | Higgins | 166/247 |

OTHER PUBLICATIONS

"Underground Gasification of Coals," Cherin et al., The Colliery Guardian, vol. CLII, No. 3939, June 26, 1936.

"Four New Ways to Manufacture High BTU Gas From Coal," Chemical Engineering, Aug. 1947, pp. 104–106.

*Primary Examiner*—Ernest R. Purser

[57] ABSTRACT

This invention relates to the production of combustible gases from coal in situ, in which one or more passages are established between the surface of the ground and an underground coal deposit. The coal is set afire and the fire is sustained by injection of an oxidizer for a period of time. Oxidizer injection is terminated, followed by injection of steam for a period of time into the hot coal bed. Produced gases are captured at the surface. Products of combustion from the burn cycle are saved at the surface, reconstituted by the addition of oxygen, then reinjected for subsequent burn cycles until the sulfur dioxide content is sufficiently high to warrant recovery in surface facilities. Condensible gases are cooled in surface facilities with liquids captured apart from noncondensible gases.

18 Claims, 2 Drawing Figures

GASIFICATION OF COAL IN SITU

BACKGROUND OF INVENTION

It is well known in the art how to manufacture blue gas, sometimes called water gas, in surface facilities. In the typical case aboveground, coal is prepared by removing the fines, so that the charge to gas producer will be reasonably uniform in lump size, for example, 2 to 4 inch thicknesses. Once the gas producer is charged, the fuel is set afire, followed by alternate cycles of blowing with air and runs with steam. Once the gas producer becomes stabilized the alternating cycles are established in rhythm, a set time period for the blow, for example three minutes, followed by a set time period for the run, for example, five minutes, then the cycles are repeated until the fuel is substantially consumed. Then the ash is disposed of and the gas producer is recharged to repeat the process. In this manner during the run cycle blue gas with a calorific content of about 300 BTU per standard cubic foot is manufactured. In reviewing the steps of the method of the prior art it should be noted that there are numerous costly batch operations on the fuel side beginning with the coal which include grub, convey, size, sort, transport, offload; then at the gas producer site: pickup, sort, charge, blow, run and clean up.

In the combustion of a hydrocarbon such as coal, the combustion process occurs either in an oxidizing environment or a reducing environment or a combination of the two. In the oxidizing environment hydrogen combines with oxygen to form water vapor, carbon combines with oxygen to form carbon dioxide, and any sulfur present will combine with oxygen to form sulfur dioxide. In the reducing environment the hydrogen combines with oxygen to form water vapor, carbon combines with oxygen to form carbon monoxide, carbon dioxide (if present) combines with hot carbon to form carbon monoxide, and sulfur combines with hydrogen to form hydrogen sulfide.

Of the products of combustion the ones that are likely to become injurious to plant and animal life are the sulfur compounds. Hydrogen sulfide is a noxious poison which is easily contained in a closed system and can be removed from the exit gases and converted into elemental sulfur by a number of commercial processes. Sulfur dioxide is not so easily separated although there are many noncommercial methods for extracting it from the products of combustion. In reviewing the methods of manufacture of sulfuric acid, a common first step is to convert elemental sulfur into sulfur dioxide in essentially pure form. The sulfur dioxide content of the products of combustion when burning coal, while often in sufficient strength to cause environmental problems, is quite weak in comparison to the strength required for processing into sulfuric acid by processes heretofore known.

OBJECTS OF THE INVENTION

It is an object of the present invention to provide a new and improved method of manufacturing combustible gases from coal in situ thereby eliminating many of the costly batch operations from the processes of the prior art.

It is an object of the present invention to provide a new and improved method of enriching the sulfur dioxide content of the products of combustion from coal in situ so that the sulfur dioxide may be recovered in useful form.

Other objects, advantages and capabilities of the present invention will become more apparent as the description proceeds and in conjunction with the accompanying drawings.

SUMMARY OF INVENTION

Figure 1:
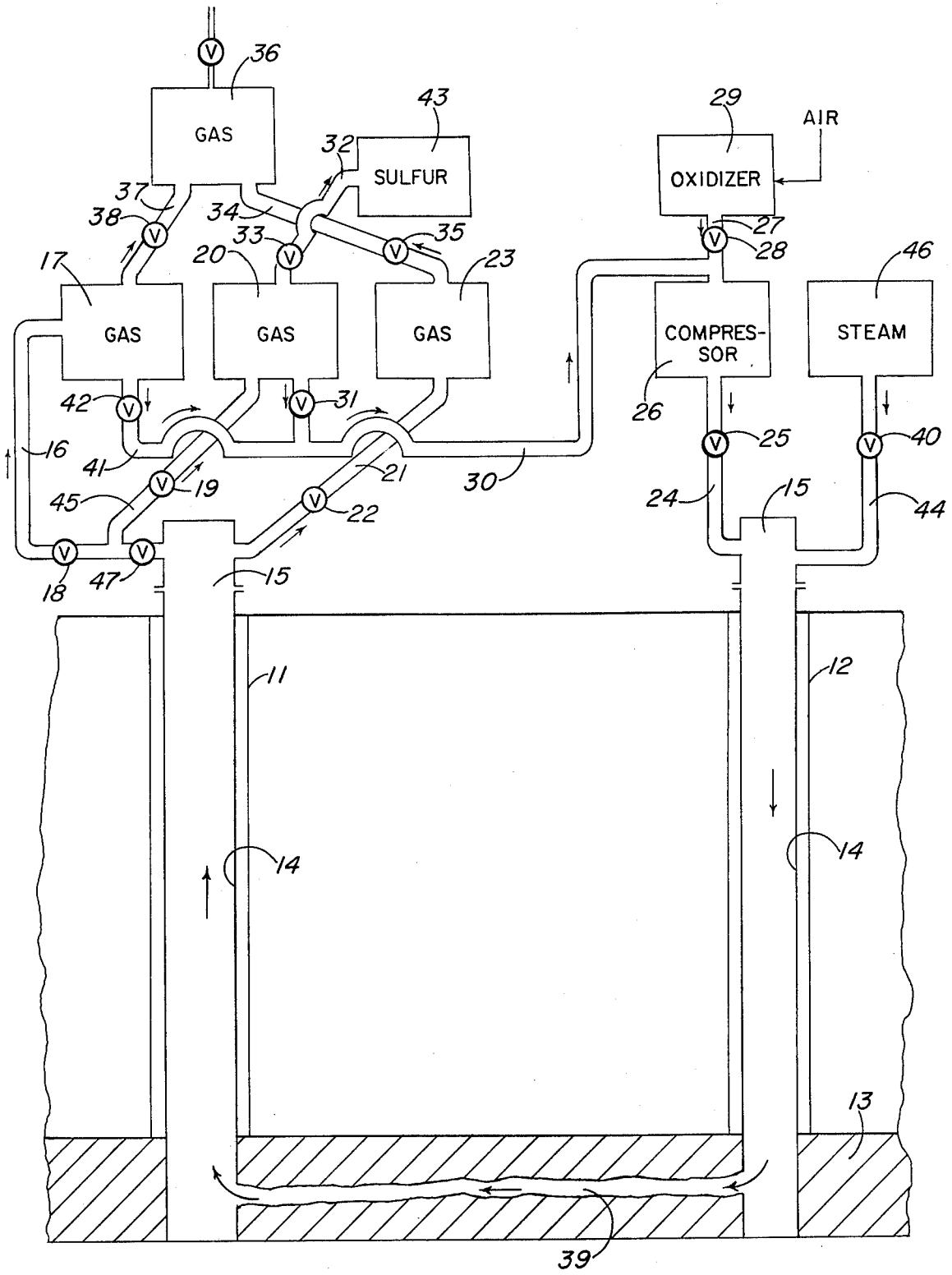
FIG. 1 is a diagrammatic vertical section taken through the earth showing coal formation as it exists during an in situ gasification program, together with associated facilities normally located above ground and shown in block forms.

By way of example only a subbituminous coal deposit is described containing approximately 1.5% sulfur by weight and located several hundred feet below the surface of the ground. Preferably the project has been operating as an in situ project designed to generate low BTU gas such as taught in my copending U.S. Pat. application Ser. No. 531,453, and a channel in the coal bed between two wells has enlarged to the point that it is difficult to maintain a reducing environment. Under these circumstances the products of combustion will have decreasing quantities of carbon monoxide content with a corresponding decrease in calorific content of combustible exit gases, sometimes called flue gas. Initially the passage between the two wells may have generated low BTU gas in the order of 200 BTU per standard cubic foot, while in the latter stages of the gasification program the passage between the two wells may be generating gas in the order of 50 BTU per standard cubic foot. With an open channel in the coal formation between the two wells, combustion is taking place in a predominantly oxidizing environment and is ideally suited to the methods of the present invention.

No particular novelty is claimed in the use of an oxidizer such as air to increase the temperatures of residual coal, nor the use of steam to react with the hot coal. The reactions with air include:

1 $C+O_2+3.8N_2=CO_2+3.8N_2+174{,}250$ BTU

2 $C+CO_2=2CO-70{,}010$ BTU and with steam:

3 $C+H_2O=H_2+CO-51{,}100$ BTU

4 $C+2H_2O=2H_2+CO_2-32{,}180$ BTU

In the open channel through the coal underground, by injecting air into one well and removing the products of combustion through the second well, the exothermic reaction (1) above serves to raise the temperature of the coal as well as to generate considerable sensible heat in the exit gases, while the embodiment reaction 2) moderates the amount of heat added. It is not unusual to find the temperature of the coal and the exit gases in the order of 2000° F and higher. At a convenient time the air injection is terminated and steam injection is begun. During the steam run the endothermic reaction (3) is predominant until the temperature of the coal diminishes to in the order of 1700° F, where the predominant reaction (4) continues to about 800° F, at which point very little of the steam enters the reaction. Maximum hydrogen output occurs at about 1350° F, a useful temperature marker if a project is designed for the primary purpose of generating low cost hydrogen to be used as a synthesis gas. Underground reaction temperatures at the beginning of the steam run can be lowered more quickly to approach the optimum hydrogen generation temperature by injecting water in the first part of the run and changing to steam as the reaction zone temperature approaches 1350° F. Another method of lowering temperature is to reinject the exit gases that contain a high percentage of carbon dioxide so that reaction (2) above becomes active.

Thus it may be seen that a pair of wells from an in situ gasification project that were declining in commercial productivity and approaching economic depletion, may be revitalized using the methods of the present invention, resulting in greater production of coal reserves within the influence of the wells than has been possible heretofore. It must be appreciated that the methods of the present invention can also be applied to virgin underground coal deposits by creating underground passages for the purposes intended. Also it may be seen that the present invention teaches methods that provide greater flexibility in the commercial processes available for use in production of coal in situ, as will become more apparent as the disclosure proceeds.

In reviewing the coal cited in the example above with 1.5% sulfur content, for each 100 pounds of coal approximately 1.5 lb. of sulfur is available for conversion into sulfur dioxide when combustion is conducted in an oxidizing environment. It is recognized that low concentrations of sulfur dioxide in a gas stream makes difficult the separation of sulfur dioxide for a useful purpose. With increasing concentrations of sulfur dioxide, the likelihood of using it for commercial purposes also increases. It is well known that concentrations of sulfur dioxide approaching 100% make an excellent feedstock for sulfuric acid plants. Lesser concentrations also are useful for the manufacture of sulfuric acid and other commercial products.

The sulfur dioxide content of the exit gases produced by the oxidizer injection cycle hereinafter called the blow cycle of the present invention may be increased by capturing the exit gases at the surface and storing them temporarily in appropriate facilities, for example a conventional gasholder. In a subsequent blow cycle the gases may be withdrawn from the gasholder for reinjection in their present state for a reducing environment or for reinjection by adding oxygen to the mixture of gases in the proper proportions to make the reconstituted gases an appropriate substitute for air or other oxidizer used in the blow cycle (oxidizing environment). By repeating the sequence of capturing a portion of the exit gases, adding oxygen and reinjecting the mixture, the concentration of sulfur dioxide may be strengthened in the exit gases.

In practicing the methods of the present invention a considerable amount of sensible heat will be contained in the exit gases, particularly in the blow cycle and with lesser amounts in the reducing environment cycle hereinafter called the run cycle. Sensible heat thus produced may be captured in part for useful work by using methods taught in my copending U.S. Pat. Application Ser. No. 531,453 or by directing the exit gases through a waste heat boiler at the surface.

One of the basic purposes of producing coal in situ is to generate combustible gases that are delivered to the surface for further useful work. The state of the art has not yet advanced to the point where calorific content of the combustible gas from an individual well can be stabilized at the design level of the overall project. For example if the project is designed for delivering combustible gas with a BTU content of 100 BTU per standard cubic foot using air as the oxidizer, among the multiplicity of gas recovery wells operating in the project one may be delivering 150 BTU gas, another 80 BTU, another 50 BTU and so on. It would be a most fortuitous circumstance if the full output capacity of all wells resulted in a gas of 100 BTUs. Should this not be the case in the prior art it is necessary to adjust the output of various wells to achieve a composite delivered gas of the proper calorific content. In some cases it may be necessary to abandon wells that are making very low BTU gases, for example those making gas with a content of 50 BTU per standard cubic foot or less. As pointed out previously these wells are good candidates for continued production using the methods of the present invention.

An improvement in gas quality control can be made over the prior art by providing suitable gasholders at the surface. One gasholder can be used to receive the exit gases from the blow cycle of the present invention, while a second gasholder can be used to receive the exit gases from the run cycle of the present invention. The first gasholder then would contain, for example, produced gases with a calorific content of 50 BTU per standard cubic foot while the second gasholder would contain produced gases with a calorific content of, for example, 300 BTU per standard cubic foot. Thus by apportioning the gas from the first and second gasholders into a third gasholder, the calorific content of the gas in the third gasholder can be stabilized at the design level, for example, a composite delivered gas at 100 BTU per standard cubic foot. Should there be insufficient quantities of gas available from the first gasholder, for example, to make a proper blend into the third gasholder, the blow cycle on one or more wells can be lengthened compared to the run cycle. Those skilled in the art will envision other adjustments to the methods of the present invention in order to achieve a final delivered gas that meets project design specification.

DESCRIPTION OF THE PREFERRED EMBODIMENT

Referring to FIG. 1, two or more wells 11 and 12 are drilled from the surface of the ground into an underground coal formation 13. A protective casing 14 is set in each well and cemented in place to provide a hermetic seal. An appropriate wellhand 15 is affixed to the top of the casing at convenient point above the surface of the ground so that the hermetic seal is maintained and to provide control for passages of the gases. From the wellhead of well 11 a flow line 16 containing valves 47 and 18 is connected to gasholder 17, and an alternate flow line 45 containing valve 19 is connected from flow line 16 to gasholder 20. Also from the wellhead of well 11 a flow line 21 containing valve 22 is connected to gasholder 23. From the wellhead of well 12 a flow line 24 containing valve 25 is connected to compressor 26. Compressor 26 is also connected by flow line 27 containing valve 28 to oxidizer plant 29, and by flow line 30 containing valve 31 to gasholder 20. Gasholder 20 is also connected by flow line 32 containing valve 33 to sulfur plant 43. Gasholder 23 is is further connected by flow line 34 containing valve 35 to gasholder 36. Gasholder 17 is further connected by flow line 37 containing valve 38 to gasholder 36, and by flow line 41 containing valve 42 to flow line 30.

Preferably wells 11 and 12 have been operated as in situ gasification wells and a channel 39 has been burned through coal bed 13 to provide a free flowing conduit between the lower portions of the wells. If such is the case the coal abutting onto the channel will be above its ignition temperature and will readily burn when an oxidizer is injected into channel 39. If the coal bed 13 has not been subjected to gasification a suitable channel can be established by igniting the coal and burning a channel using methods taught in my copending U.S. Pat. Application Ser. No. 531,453 or other appropriate in situ gasification methods.

The process begins by closing all valves, starting compressor 26 using intake air and opening valve 25. The system will soon come up to operating pressure, for example 100 psig, at which point valve 18 is fully opened and valve 47 is opened to the extent necessary to maintain back pressure for the desired mine pressure. If coal bed 13 is an aquifer the preferred mine pressure in the reaction zone channel 39 is slightly above the hydraulic head pressure to exclude the flow of encroachment water. In this mode air is supplied to channel 39 through well 12, the coal bed 13 burns in a predominantly oxidizing environment and the products of combustion are delivered through well 11 to gasholder 17. The blow cycle continues underground for an appropriate period of time, for example 20 minutes, and the cycle is terminated with all valves closed. The blow cycle duration is selected with due regard for the amount of coal exposed to the reaction zone in channel 39, which in turn is a function of the average periphery of the cross section of channel 39 and the distance between wells 11 and 12.

The process continues by opening valve 40 and injecting steam from steam generator 46 through flow line 44 into channel 39 through well 12 at appropriate pressure, for example 100 psig. Valve 22 is opened to the extent necessary to maintain mine pressure, and the gas from the reaction zone in channel 39 is delivered through well 11 to gasholder 23. The run cycle continues for an appropriate time, for example 30 minutes, and the cycle is terminated by closing all valves. The duration of the run cycle is selected with due regard for the amount of hot coal that is available for reaction.

Should it be desirable to optimize the amount of hydrogen produced in the run cycle, the temperature of the reaction zone may be lowered more rapidly by reducing the mine pressure below hydrostatic head pressure to permit ingress of formation water into the reaction zone, or by injecting water into the reaction zone through well 12. As the reaction zone temperature approaches the optimum temperature for generation of hydrogen, for example 1350° F, mine pressure is restored to normal, for example 100 psig, by terminating water injection and proceeding with steam injection for the balance of the run cycle.

An alternate method of the run cycle in reducing the temperature in the reaction zone is to maintain mine pressure, for example 100 psig, and inject products of combustion from gasholder 17 through flow line 41 and valve 42 into flow line 30 through compressor 26, through flow line 24 into well 12 through channel 39 and on to the surface via well 11. Using this alternate method the carbon dioxide in the gas mixture is available to combine with hot carbon in channel 39 to form carbon monoxide. The exit gases from this alternate method may be directed from well 11 at the surface to gasholder 17, gasholder 20 or gasholder 23, depending on the plan for gas utilization. Again should the plan be for maximum hydrogen generation, this alternate run method can be terminated when the reaction zone temperature nears the optimum temperature, for example 1350° F, then continuing the run cycle with injection of steam into the reaction zone.

Should it be desirable to increase the content of sulfur dioxide in the exit gases the blow cycle may be undertaken as described above except rather than collecting all of the exit gas in gasholder 17, a portion is diverted into gasholder 20 from well 11 through flow line 45 by opening valve 47, partially opening valve 19 and holding proper back pressure on valve 18. At the conclusion of the blow cycle all valves are closed. For the next blow cycle gas from gasholder 20 is directed through flow line 30 through valve 31 where it is blended with an oxidizer from oxidizer plant 29 through valve 28 into compressor 26. The resultant blended gas would have preferably the approximate amount of oxygen as contained in the air. By repeating this alternate blow cycle the sulfur dioxide content of exit gases from reaction zone 39 can be increased to an appropriate level and delivered to sulfur conversion plant 43 through flow line 32.

Using the air blow and the steam run cycles, collecting the air blow gases in gasholder 17 and the steam run gases in gasholder 23, an appropriate end product combustible gas can be delivered to gasholder 36. If the end product gas is specified, for example, to contain 100 BTU per standard cubic foot, such a gas may be blended by apportioning the gas streams from gasholder 17 through flow line 37 and from gasholder 23 through flow line 34 with appropriate settings of valves 38 and 35.

Additional flexibility in the overall project can be gained by adjusting the elements of the methods described above to achieve the project objective, for example to deliver 100 BTU gas for commercial use. Each well in the multiplicity of wells may be operated up to their maximum capabilities with each well contributing its proportionate part to the overall project. For example if it is necessary to have a larger volume of gases in gasholder 17 for blending purposes into gasholder 36, this larger volume can be attached by increasing the length of the blow cycle in one or more pairs of wells. The blow cycle could be extended for example from 20 minutes to for example 30 minutes. If it is desirable to increase the calorific content of the gas mixture in gas holder 17, this can be accomplished by directing a portion of the gases in gasholder 17 to the reaction zone underground for the first part of each run cycle, then directing the exit gases back to gasholder 17. The temperatures in the reaction zone may be increased for a longer run cycle and consequently more volume of gases for delivery to gasholder 22, by increasing the oxygen content of the oxidizer for the blow cycle, and the like.

Figure 2:
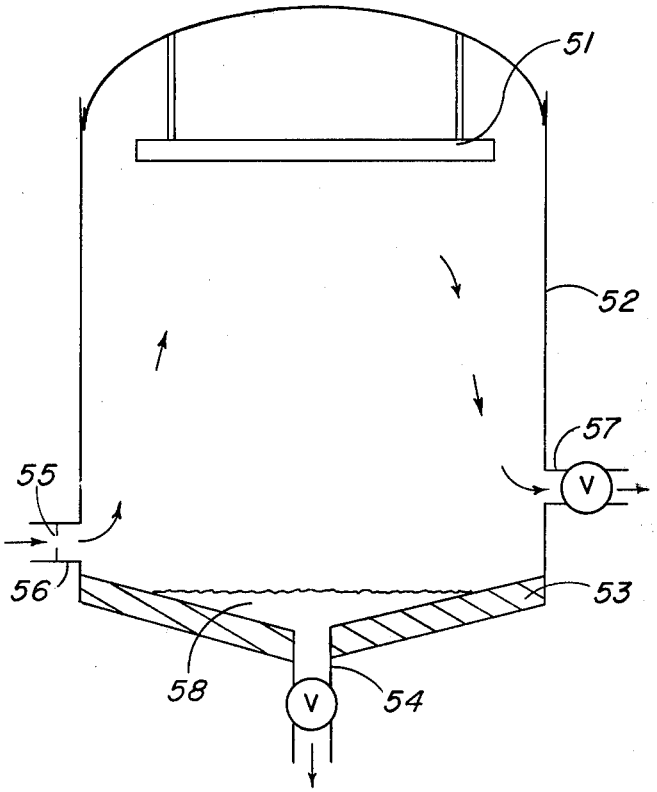
FIG. 2 is a diagrammatic vertical section taken through a gasholder.

The gases directed to the various gasholders aboveground will contain both condensible and non-condensible components. Referring to FIG. 2 when the temperature of the gases is lowered, some of the component gases will reach their dew point and liquids 58 will collect in the lower section of gasholder 52. These liquids contain valuable coal chemicals and may be removed by placing a suitable outlet 54 in the gasholder. Generally it is preferable to remove condensible gases from the gas stream to avoid plugging the outbound pipeline 57 that delivers the gases from the project to the point of use. By placing a suitable heat exchanger 51 in gasholder 52, temperature of the gases can be reduced to a point, for example a temperature lower than the lowermost temperature expected in the outbound pipeline, so that substantially all of the condensible gases are converted to liquids before the gases are delivered to the outbound pipeline. In some cases the temperature desired may be low enough to cause the condensed liquids to become semisolids or solid substances. In these cases it may be necessary to add heat in heat exchanger 53 for brief periods to fluidize the congealed substances so that they may be captured apart as liquids through conduit 54. Another method of lowering the temperature of the gases delivered to gasholder 52 is to expand inbound gases in pipeline 56 through orifice 55 so that liquids are removed from the gas and are collected in the lower section 58.

Thus it may be seen that the present invention provides many advantages and capabilites over the prior art. Since the coal is consumed in situ, it is not necessary to perform the many costly batch operations inherent in removing coal from underground, preparing it for use and delivering the coal to an above ground gas producer which may be many miles apart from the coal mine. The above ground gas producer which is comprised of costly equipment with many moving parts has been eliminated because the reaction zone has been established in the coal bed itself where the ash remains in situ instead of causing a disposal problem above ground. Many limitations imposed by prior art for gasification of coal in situ also have been eliminated.

Although the present invention has been described with a certain degree of particularity, it is understood that the present disclosure has been made by way of example and that changes in details of structure may be made without departing from the spirit thereof.

What is claimed is:

1. A method of gasifying coal in situ wherein the underground coal deposit has been preheated to a temperature above the ignition point temperature comprising the steps of:

establishing fluid injection and fluid removal passages connecting the coal formation to a surface location, establishing a fluid passage through the coal interconnected with the fluid injection and removal passages, injecting an oxidizer, gasifying the coal and capturing the gases at the surface;

terminating oxidizer injection, then injecting a reducing reactant fluid, gasifying the coal, and capturing the gases at the surface.

2. The method of claim 1 wherein the oxidizer is air.

3. The method of claim 1 wherein the oxidizer is oxygen enriched air.

4. The method of claim 1 wherein the oxidizer is flue gas enriched with oxygen.

5. The method of claim 1 wherein the reducing reactant fluid is steam.

6. The method of claim 1 wherein the reducing reactant fluid is carbon dioxide.

7. The method of claim 1 further including selective adjustment of the pressure in the fluid passages underground to permit encroachment of water into the reaction zone and to exclude encroachment of water into the reaction zone.

8. A method of gasifying coal in situ wherein the underground coal deposit has been preheated to a temperature above the ignition point temperature comprising the steps of:

establishing fluid injection and fluid removal passages connecting the coal formation to a surface location establishing a fluid passage through the coal interconnected with the fluid injection and removal passages injecting an oxidizer, gasifying the coal and the sulfur content of the coal, and capturing the gases at the surface; then reinjecting the captured gases together with an oxidizer, gasifying the coal and the sulfur content of the coal, and capturing the gases at the surface.

9. A method of gasifying coal in situ wherein underground processing steps are conducted in concert with aboveground processing steps in order to operate the system at full capacity while delivering a product gas that meets predetermined specifications comprising the steps of:

establishing fluid injection and fluid removal passages connecting the coal formation to a surface location, establishing a fluid passage through the coal interconnected with the fluid injection and fluid removal passages, establishing a first receptacle at the surface, establishing a second receptacle at the surface, establishing a third receptacle at the surface, igniting the coal underground, injecting an oxidizer, gasifying the coal, and capturing the gases in the first receptacle;

terminating oxidizer injection, then injecting a reducing reactant fluid, gasifying the coal, and capturing the gases in the second receptacle;

passing the gases from the first receptacle to the third receptacle, and passing the gases from the second receptacle to the third receptacle.

10. The method of claim 9 further including the steps of adjusting the time period for injection of oxidizer as compared to the time period for injection of the reducing reactant fluid and apportioning the gases passed from the first receptacle to the third receptacle.

11. The method of claim 9 further including the steps of adjusting the time period for injection of reducing reactant fluid as compared to the time period for injection of oxidizer and apportioning the gases passed from the second receptacle to the third receptacle.

12. The method of claim 9 further including the step of adjusting the quantity and quality of the injected oxidizer.

13. The method of claim 9 further including the step of adjusting the quantity and quality of the injected reducing reactant fluid.

14. The method of claim 9 further including the steps of injecting a first reducing reactant fluid, terminating the injection of the first reactant fluid, then injecting a second reducing reactant fluid.

15. The method of claim 14 wherein the first reducing reactant fluid is carbon dioxide and the second reactant fluid is steam.

16. A method of gasification of coal in situ wherein the underground coal deposit has been preheated to a temperature above the ignition point temperature comprising the steps of:

establishing fluid injection and fluid removal passages connecting the coal formation to a surface location, establishing a fluid passage through the coal interconnected with fluid injection and fluid removal passages, injecting a reactive fluid, gasifying the coal into condensible and non-condensible gases, establishing a receptacle for the gases at the surface, establishing a heat transfer means within said receptacle, capturing the gases in the said receptacle, lowering the temperature of the gases in the said receptacle, and capturing the condensed liquids apart from the gases.

17. The method of claim 16 further including the step of expanding the gases inbound to said receptacle.

18. The method of claim 16 further including the step of adding heat to the captured liquids.

* * * * *